US005820636A

United States Patent [19]

Angstmann et al.

[11] Patent Number: 5,820,636

[45] Date of Patent: Oct. 13, 1998

[54] CONTINUOUS PRETREATMENT OF CELLULOSIC TEXTILE MATERIAL

[75] Inventors: Heinz-Dieter Angstmann; Dieter Bassing; Peter Freyberg, all of Ludwigshafen, Germany

[73] Assignee: BASF Aktiengesellschaft, Ludwigshafen, Germany

[21] Appl. No.: 537,750

[22] PCT Filed: May 10, 1994

[86] PCT No.: PCT/EP94/01507

§ 371 Date: Nov. 15, 1995

§ 102(e) Date: Nov. 15, 1995

[87] PCT Pub. No.: WO94/28228

PCT Pub. Date: Dec. 8, 1994

[30] Foreign Application Priority Data

May 21, 1993 [DE] Germany ..... 43 17 060.9

[51] Int. Cl.[6] ..... D06L 3/02; D06L 1/14

[52] U.S. Cl. ..... 8/111; 8/137; 8/138; 435/263

[58] Field of Search ..... 8/111, 138, 137; 435/263

[56] References Cited

U.S. PATENT DOCUMENTS

| | | | |
|---|---|---|---|
| 2,960,383 | 11/1960 | Potter et al. | 8/111 |
| 4,426,203 | 1/1984 | Abel et al. | 8/138 |
| 4,539,353 | 9/1985 | Abel et al. | 524/123 |

FOREIGN PATENT DOCUMENTS

| | | |
|---|---|---|
| 55975 | 7/1982 | European Pat. Off. . |
| 114788 | 8/1984 | European Pat. Off. . |
| 0 101 567 | 5/1988 | European Pat. Off. . |
| 27 35 816 | 8/1977 | Germany . |
| 28 14 354 | 8/1982 | Germany . |
| 42 08 106 | 3/1992 | Germany . |
| 2002831 | 2/1979 | United Kingdom . |

OTHER PUBLICATIONS

Database WPI, Section Ch, Derwent Publications, Ltd., London, GB; Class E17, AN 71–50269s, abstract for JP, B, 46–026426 (month unknown), 1971.

*Primary Examiner*—Alan Diamond
*Attorney, Agent, or Firm*—Oblon, Spivak, McClelland, Maier & Neustadt, P.C.

[57] ABSTRACT

A process for the continuous pretreatment of cellulosic textile material comprises a) a precleaning step wherein the treatment bath used comprises customary surfactants and other customary auxiliaries with or without customary enzymes as desizing agents and has a pH of from 5 to 11, and, after washoff and rinse, b) a bleaching step with hydrogen peroxide in an alkaline-aqueous liquor which comprises customary surfactants and other customary auxiliaries, wherefor the treatment bath of (a) additionally comprises from 1 to 10% by weight, based on the weight of the textile material, (i) either of an aminopolycarboxylic acid, of a hydroxyalkyl- or amino-phosphonic acid, of a polycarboxylic acid, of a polyhydroxycarboxylic acid or of an inorganic polymetaphosphate, or a mixture thereof, as complexing agent for polyvalent metal ions, or (ii) of a water-soluble polymer derived from 40 to 100% by weight of monoethylenically unsaturated mono- or dicarboxylic acids or anhydrides, or a mixture thereof, and has a K value of from 8 to 80, as dispersant, or (iii) a mixture of components (i) and (ii) in a weight ratio of from 10:1 to 1:10.

10 Claims, No Drawings

CONTINUOUS PRETREATMENT OF CELLULOSIC TEXTILE MATERIAL

This application is a 371 of PCT/EP94/01507 filed May 10, 1994.

The present invention relates to an improved process for the continuous pretreatment of cellulosic textile material comprising (a) a precleaning step wherein the treatment bath used comprises customary surfactants and other customary auxiliaries with or without customary enzymes as desizing agents and has a pH of from 5 to 11, and, after wash off and rinse, (b) a bleaching step with hydrogen peroxide in an alkaline-aqueous liquor which comprises customary surfactants and other customary auxiliaries, Wovens are customarily subjected to a three-stage pretreatment comprising desizing, scouring and bleaching. Each of these three treatment steps divides into an impregnating step, in which the treatment liquor is applied to the textile material, a dwell stage, in which the chemicals and auxiliaries applied to the textile material can react, and a washoff stage.

The present pretreatment process allows significant gains to be made in efficiency. All that is required to obtain good bleach results with a minimum of fabric damage is a precleaning step, wherein the treatment liquor (impregnating liquor), which contains certain additives, is applied to the textile material and washed off immediately thereafter, without dwell time, and also a bleach directly thereafter. Particularly good bleach results are obtained on impregnating with an increased bleaching liquor add-on. These good results, which substantially correspond to those of the customary three-stage pretreatment, were unforeseeable.

If the precleaning liquor of (a) does not contain the additives mentioned hereinafter, then the bleach results will be poor. In the case of difficult-to-remove, water-insoluble starch sizes on the fabric, the desizing effect may not be sufficient in some cases. In these cases, the impregnation of (a) has to be additionally followed by a desize with customary starch-degrading enzymes. However, in such cases it is more sensible to carry out the present pretreatment process after the desize by adding the below-mentioned additives to the first or second wash bath at the end of the desizing process. It is also possible to add the below-mentioned additives directly to the desizing liquor which contains the starch-degrading enzymes.

All the process variants mentioned surprisingly give good bleach results which are at least comparable to those of a customary three-stage procedure.

Cotton as a natural product includes, in addition to its main component, cellulose, up to 10% by weight of natural impurities which can vary greatly depending on origin, provenience, growth conditions and ripeness at the time of harvest. Such natural concomitants of cotton are in particular proteins, pectin, waxy esters and waxy alcohols, hemicellulose, lignin substances, resins, colored pigments, organic acids and mineral salts with the cations of Ca, Mg, Na, K, Fe, Mn, Cu and Al and the anions carbonate, phosphate, sulfate, chloride and silicate.

These impurities mean that raw cotton is completely water-repellent and has a harsh, unacceptable hand and also a yellowish/brownish appearance and would lead to appreciable problems in bleaching, dyeing or printing. Therefore, they must first be removed as completely as possible.

In addition to these natural concomitants, there are also substances applied, purposively or inadvertently, during growth and in the course of the processing stages. Here a distinction has to be made between substances applied in the course of growth and harvest (eg. leaf and stem remains, defoliants, insecticides, fungicides), substances applied in the course of yarnmaking and processing (eg. spin finishes, detrital metal, rust stains), substances applied in the making of knits, and substances applied in the making of wovens.

Weaving imposes mechanical stresses on the warp threads, from which they have to be protected by polymer films surrounding them. The sizes applied for this purpose, which differ very widely in constitution and solubility (examples being starch, starch ethers, starch esters, carboxymethyl starch, carboxymethylcellulose, methylcellulose, polyvinyl alcohol, polyacrylates), additionally include sizing aids (eg. animal fats, partially emulsified; synthetic waxes; paraffins) for optimum processing.

All the abovementioned natural and processing-based concomitants of very different chemical constitutions can be present on the cotton fiber. They all have an essentially negative effect on the processing stages of bleaching, dyeing and printing, and, if not properly removed, can show themselves adversely in, for example, inadequate hydrophilicity, insufficient bleach effects, fabric damage in the course of the bleach, precipitations in the treatment liquors, roll deposits, brown specks due to the seed husks, unlevel dyeings or prints or poor color fastness properties.

The object of the pretreatment is to prepare the textile material so that contrary concomitants are removed as substantially as possible and in particular as uniformly as possible without excessively damaging in the course thereof the bared clean cotton, the α-cellulose. Owing to the variety of these substances not only in their physical appearance but also in the aforementioned chemical constitution, this cannot be achieved with a simple washoff.

The conventional continuous woven fabric pretreatment customarily employs three stages for optimal removal of the impurities: desizing—alkaline scouring—bleaching. The objectives are, in desizing, the breakdown and the removal of the sizes and a precleaning, in scouring the substantial removal of fiber concomitants, swelling of the cellulose and an incipient swelling of the seed husks, and in bleaching the destruction of colored concomitants and of the seed husks and a good bleach effect.

Knits are normally not sized and therefore, unlike wovens, require no desizing step.

It is an object of the present invention to achieve better bleach effects than the prior art pretreatment while working more efficiently.

We have found that this object is achieved by the above-defined process wherefor the treatment bath of (a) additionally comprises from 1 to 10% by weight, preferably from 2 to 6% by weight, based on the weight of the textile material, (i) either of an aminopolycarboxylic acid, of a hydroxyalkyl- or amino-phosphonic acid, of a polycarboxylic acid, of a polyhydroxycarboxylic acid or of an inorganic polymetaphosphate, or a mixture thereof, as complexing agent for polyvalent metal ions, or (ii) of a water-soluble polymer derived from 40 to 100% by weight of monoethylenically unsaturated mono- or dicarboxylic acids or anhydrides, or a mixture thereof, and has a K value of from 8 to 80, as dispersant, or (iii) a mixture of components (i) and (ii) in a weight ratio of from 10:1 to 1:10.

In a preferred embodiment, the treatment bath of (a) additionally comprises from 1 to 10% by weight, based on the weight of the textile material, of component (i). In a further preferred embodiment, the treatment bath of (a)

additionally comprises from 1 to 10% by weight, based on the weight of the textile material, of component (ii). In a further preferred embodiment, the treatment bath of (a) additionally comprises from 1 to 10% by weight, based on the weight of the textile material, of a mixture (iii) of components (i) and (ii) in a weight ratio of 10:1 to 1:10, preferably in a weight ratio of from 4:1 to 1:4.

The process of the present invention, involving the presence of dispersants and/or complexing agents in the precleaning liquor as well as the customary wetting agents, washing agents and auxiliaries, produces such an effective removal of the contraries that the subsequent peroxide bleach proceeds with higher alkali levels and also, if necessary, higher peroxide levels to produce excellent bleach results and without significant fabric damage and the alkaline scour can be dispensed with.

The dispersants added according to the present invention are capable of dispersing insoluble compounds of the inorganic and organic kind, for example insoluble hydroxides or carbonates of alkaline earth or heavy metals and also insoluble salts of these cations with, for example, pectinate, fatty acids or sizes, and thereby also preventing precipitations and roll deposits as well as producing the improved precleaning effect.

The novel addition of complexing agents for polyvalent metal ions also removes alkaline earth and heavy metal ions from the cotton by complexing, thereby prevents precipitations of insoluble salts of these cations and thus creates ideal preconditions for a subsequent, problem-free peroxide bleach and the later dyeing.

The novel presence of dispersants and/or complexing agents in the precleaning liquor, the inclusion of the precleaning process (a), and the washoff of the dispersed and/or dissolved impurities serves to free the textile material from contraries so efficiently that, in the subsequent peroxide bleach (b), it behaves significantly better than without the additions according to the present invention, better even than after an additional alkaline scour prior to the peroxide bleach.

The advantageous effects and consequences of the process of the present invention are essentially discernible only in and after the peroxide bleach, although immediately following the preclean it is usually found that the additives of the present invention have brought about better hydrophilicity and that, as a measure of the cleaning effect, there are distinctly reduced levels of, for example, Ca, Mg and Fe on the textile material.

The peroxide bleach brings about the following surprising effects:

higher bleach effect (measured as Berger whiteness)

lower peroxide consumption lower fabric damage good hydrophilicity.

Husk removal is a question of bleaching time and amount of alkali and peroxide. Good husk removal normally requires an alkaline scour with from 30 to 60 g/l of caustic soda and a customary wetting agent or detergent at 100° C. for from 2 min to 30 min following the normal desize and a subsequent peroxide bleach with from 30 to 50 ml/l of hydrogen peroxide (35% strength by weight) and from 5 to 10 g/l of caustic soda as well as the customary bleach stabilizers and wetting or washing agents. A peroxide bleach directly following a normal desize usually does not bring about husk removal, since the high alkali levels necessary for husk removal (>10 g/l of caustic soda) promote severe peroxide decomposition and lead to severe fabric damage.

The process of the present invention results in a fabric which is free of impurities that would interfere with the peroxide bleach and which makes possible a peroxide bleach even with distinctly higher amounts of caustic soda with excellent bleach results, without fabric damage and free of seed husks. The bleach can also be carried out with high peroxide levels and a longer bleaching time (up to 60 min) without significant fabric damage. Owing to the excellent stability of the peroxide and its optimum utilization for the bleaching of the colored concomitants of the cotton (and not large losses due to consumption for oxidizing other impurities present on the cloth), however, the amount of peroxide can be distinctly reduced without large reductions in the bleach effect; this is a further advantage of the process of the present invention.

The advantages of the process of the present invention are also discernible after dyeing the textile material which has been pretreated according to the present invention. This is because it is known that alkaline earth and heavy metal ions form insoluble compounds and complexes with some dyes and thereby can bring about hue shifts and depth of shade changes. The pretreatment carried out according to the present invention produces more uniform and more solid dyeings than the normal desizing process.

DE-A-27 35 816 (1) describes a process for desizing and bleaching cellulosic textile material by simultaneous enzymatic desizing and pretreating with a solution of sodium dithionite and a customary heavy metal complexing agent in the presence of a buffer system at from pH 6 to 9 and subsequent customary peroxide bleach in the presence of little or no silicate as stabilizer.

Sodium dithionite acts as a reducing agent and requires the use of a buffer system, since the oxidation of dithionite produces not only sulfate anions but also sulfurous acid and the pH decreases as a result. This acidification of the treatment bath has to be prevented by buffering in order that the autodecomposition of the dithionite; a desertion of the best pH range for the complexing; and the occurrence of $SO_2$ odor may be avoided. The sulfate ions formed in the course of the oxidation of the dithionite pass into the wastewater, pollute it and—as known—increase the corrosion of concrete wastewater channels and pipes, also discernible from the limits for sulfate ions in wastewater set by environmental authorities.

Further disadvantages of using sodium dithionite are the need for commercialization as a powder owing to its instability in aqueous solutions, the hygroscopy and self-ignitability of the powder, and also the need for a pulverulent product even in the case of mixtures of the 3 individual components dithionite/complexing agent/buffer system, further the instability of stock solutions also, not only of dithionite but also of triple mixtures.

In contradistinction to the process described in (1), the process of the present invention requires no reducing agent and no buffer system, and thus has none of the disadvantages mentioned there. The reagents are simple to handle and use as solutions. Similarly, the complexing agents to be used can be generally complexing agents for polyvalent metal ions, not just the customary heavy metal complexing agents. It is true that heavy metal ions are to be removed as completely as possible, but additionally also alkaline earth metal ions or aluminum ions. Owing to the dispersing effect of the dispersants to be used, insoluble compounds of polyvalent metal ions are removed from the textile material too, not just soluble cations.

DE-B-28 14 354 (2) describes a process for desizing starch-sized cellulosic textiles with the aid of a combination of peroxodisulfate and of an oxidation-resistant dispersant for the water-insoluble starch molecule fragments produced by the oxidative degradation of the size. The process is preferably coupled with the alkaline scour and carried out at a pH between 12 and 14 and at a temperature of about 100° C. in the course of at least 1 minute. Despite the relatively low levels used (from 0.1 to 3 g of peroxodisulfate per liter of desizing liquor), fiber damage can never be completely avoided in the oxidative desizing process described. The oxidizing agent does not distinguish between starch and cellulose, which are chemically very similar. Good oxidative degradation of the starch is usually inevitably accompanied by oxidative damage to the cellulose fibers; if the level of fiber damage is low, the starch desize is usually unsatisfactory. The dispersants used in the process are intended to disperse the oxidative breakdown products of the starch size and have to be resistant to oxidation.

In contradistinction to the process described in (2) the process of the present invention, which dispenses with the use of peroxodisulfate as a desizing agent, precludes all these restrictions and disadvantages. The dispersants used need not be oxidation-stable and have to perform significantly more far-reaching dispersing services than the dispersion of oxidative starch degradation products. Also, fiber damage can be completely ruled out in the precleaning step (a) carried out as the first stage of the process of the present invention. If at all, such fiber damage would at most occur in the subsequent peroxide bleach (b).

EP-B-101 567 (3) relates to the preparation of aqueous concentrated homogeneous 25 to 65% strength by weight, pH 3 to 7 solutions of mixtures, preferably in a weight ratio of 7:1 to 1:7, of homopolymers of acrylic acid and/or copolymers of acrylic acid with up to 50% by weight of maleic acid and/or maleic anhydride and K values of 10 to 25 and nitrilotriacetic acid, polyaminopolycarboxylic acids, polyaminopolyphosphonic acids and/or hydroxyalkanepolyphosphonic acids, wherein the dissolved components are completely or at least 20% present in the form of the potassium salts and in the latter case the remainder is present in the form of the free acid. Their use in pretreatment baths or dyebaths for cellulosic textile material as combined dispersing and metal ion complexing agent is mentioned. A utility for precleaning or desizing baths is not mentioned.

DE-A-42 08 106 (4) discloses using a mixture of citric acid, an alkali metal or ammonium salt of a sugar carboxylic acid and optionally a small amount of mineral acid as auxiliary for finishing treatments of textile fiber material.

The claimed precleaning (a) of cellulosic textile material can be carried out continuously at liquor ratios of about 1:1 or in the case of knits even at liquor ratios of from 5:1 to 20:1. In the continuous process, the treatment liquor is applied in the course of dip times (contact times) of the textile material of customarily from 5 to 30 seconds, in particular from 10 to 20 seconds, and the treatment bath can have a temperature within the range from room temperature (20° C.) to 70° C. Following this dip or impregnation step, the cloth is squeezed off to a wet pickup of about 100% (corresponding to a liquor ratio of about 1:1) and then either immediately washed off or else subjected to a dwell time of from 5 minutes to 24 hours at room temperature or from 30 seconds to 3 minutes at about 100° C. and only then washed off. The washoff of the treated textile material is customarily carried out hot (at temperatures within the range from 80° to 100° C.) and subsequently cold, usually in a plurality of successive washbaths.

The pH of the treatment liquor of (a) should be within the range from 5 to 11, preferably within the range from 6 to 10.

In the case of knits or wovens which contain water-soluble sizes (such as, for example, starch ethers, carboxymethylcellulose, polyvinyl alcohol or polyacrylates), it is frequently sufficient to carry out the precleaning step (a) of the present invention, consisting of the impregnating of the textile material with the treatment liquor and immediate subsequent washoff, to obtain good bleach results. If the desizing effect falls short of expectations, the impregnating step can be given a longer dwell time before washoff.

In the case of water-insoluble sizes (as, for example, from native starch of maize, rice, potatoes or wheat, carboxymethyl starch, starch esters or tapioca starch), more effective measures have to be taken to achieve desizing. This is done by employing enzymatic desizing, which typically involves the use of starch-degrading α-amylase enzymes, which is therefore employed in the presence of starch or starch derivatives.

This desizing process under the action of enzymes can take place immediately following the (a) impregnating process of the present invention or thereafter, ie. in the first or second washbath following the precleaning process (a). It is also possible to introduce the additives of the present invention directly into the desizing liquor which contains the starch-degrading enzymes.

The enzymes used are usually bacterial, malt or pancreatic amylases, most enzymes being active at low temperatures (up to 70° C.). specific grades also at higher temperatures (from 70° C. to 120° C.). The amount of enzyme used is typically within the range from 1 to 8 g/l. These amylases usually are most active in a certain pH range from pH 5 to pH 11, usually from pH 6 to pH 8. Depending on the type of enzyme used and/or the time available, the impregnating of the textile material with the desizing liquor is followed by dwell or reaction times of up to 24 hours at room temperature or else of only from 1 to 2 minutes at 100° C.

The desizing liquor, in addition to any enzyme, customarily further includes wetting and washing agents (surfactants) and also further customary auxiliaries, frequently for example sodium chloride and small amounts of calcium salts (both for enzyme activation), which are either added separately or automatically introduced via the water hardness.

The peroxide bleach (b) following the preclean (a) is customarily carried out continuously at liquor ratios (ratio of weight of liquor to weight of textile material) of from 0.6:1 to 1.7:1, preferably from 1:1 to 1.5:1 (corresponding to wet pickups of 60% by weight, based on the textile material, up to 170% by weight, preferably from 100% by weight to 150% by weight). Such high wet pickups have only become possible with the advent of novel, modern application technologies (eg. "Flexnip" from Küsters, "Super-Sat" from Babcock or "Raco-Yet" from Ramisch-Kleinewefers, see DE-A-42 02 720) and, owing to the higher supply of chemicals and auxiliaries and also the increased water on the textile material, make possible the additional increase in the pretreatment result, in particular the whiteness combined with reduced fabric damage. In the case of knits, the continuous peroxide bleach can also take place from a long liquor, ie. at liquor ratios of from 6:1 to 15:1.

The peroxide bleach generally takes place at temperatures within the range from 70° to 130° C., preferably from 98° to 120° C., in the course of from 2 to 60 minutes, preferably of from 10 to 30 minutes.

Ingredients in the bleaching liquor besides hydrogen peroxide, customarily used in the form of a from 30to 50% strength by weight aqueous solution, and caustic soda, are surfactants and also other customary auxiliaries, for instance customary inorganic or organic stabilizers—which are intended to ensure an adequate stability of the hydrogen peroxide under bleaching conditions—and optionally dispersants, which are intended to prevent precipitations of insoluble compounds and roll deposits. The amounts of peroxide and caustic to be used depend on the textile material, the chosen process, and the desired bleach result, namely on whether ultimately dyed or printed coloreds or undyed and unprinted whites are to be produced. Whites require a higher degree of whiteness and a total absence of husks. The amounts of peroxide used are typically within the range from 10 to 60 g/l of $H_2O_2$ (35% strength by weight), preferably within the range from 20 to 50 g/l, and the amounts of caustic used are typically within the range from 5 to 50 g/l, preferably within the range from 10 to 25 g/l.

The preferred procedure for bleaching step (b) is a continuous procedure whereby the textile material, having passed through the claimed preclean (a) and the subsequent washoff and/or rinse, is subjected in open width to impregnation by the bleaching liquor and bleaching in a steamer at from 98° to 120° C. for from 10 to 30 minutes and a subsequent thoroughly hot (repeatedly at 95° C.) and cold washoff in a conventional manner.

Suitable complexing agents (i) for polyvalent metal ions include aminopolycarboxylic acid, hydroxyalkyl- and amino-phosphonic acids, poly(hydroxy)carboxylic acids and inorganic polymetaphosphates, as free acids or in neutralized form as alkali metal or ammonium salts. Specific examples are:

nitrilotriacetic acid, ethylenediaminetetraacetic acid, diethylenetriaminepentaacetic acid, β-hydroxyethylaminodiacetic acid, N,N-di-(β-hydroxyethyl)glycine, 1,3-propylenediaminetetraacetic acid, 1,2-propylenediaminetetraacetic acid, N-β-hydroxyethylethylenediaminetriacetic acid, 2-hydroxypropylene-1,3-diaminetetraacetic acid, di-(β-aminoethyl)oxytetraacetic acid, glycolbis(β-aminoethyl) oxytetraacetic acid, cyclohexylene-1,2-diaminetetraacetic acid, β-alaninediacetic acid, L-aparaginediacetic acid, isoserinediacetic acid, L-glutaminediacetic acid, nitrilomonoaceticdipropionic acid, nitrilotripropionic acid, ethylenediaminedisuccinic acid, poly(α-iminodiacetic acid) acrylic acid, phosphonobutanetricarboxylic acid, aminotrismethylenephosphonic acid, ethylenediaminetetraethylenephosphonic acid, hexamethylenediaminetetramethylenephosphonic acid, diethylenetriaminepentamethylenephosphonic acid, morpholinomethanediphosphonic acid, 1-hydroxy-$C_1$–$C_{10}$-alkyl-1,1-diphosphonic acids such as 1-hydroxyethane-1,1-diphosphonic acid, saccharic acids such as mannosaccharic or gluconic acid, mucic acid, lactic acid, tartaric acid, malic acid, citric acid, tartronic acid, glucoheptonic acid, poly(α-hydroxy)acrylic acid, polyacrylic acid, polymaleic acid, 1,2,3,4-cyclopentanetetracarboxylic acid, o-carboxymethyltartronic acid, o-carboxymethylmalic acid and poly(di-, tri-, tetra- or hexa-)metaphosphates.

Preferred complexing agents include aminopolycarboxylic acids, phosphonic acids and polyhydroxycarboxylic acids, in particular nitrilotriacetic acid, diethylenetriaminepentamethylenephosphonic acid and poly-α-hydroxyacrylic acid.

The complexing agents for polyvalent metal ions should ideally have sequestering properties for di- and trivalent ions of the metals Ca, Mg, Ba, Sr, Mn, Co, Cu, Fe, Ni, Co, Zn, Cd and Al, in particular for ions of the metals Ca, Mg, Fe, Cu, Mn and Zn and Al, which are found relatively frequently on raw cotton.

Suitable as dispersants (ii) include water-soluble polymers which contain monoethylenically unsaturated mono- and/or dicarboxylic acid units in amounts ≧40% by weight, preferably ≧60% by weight, in particular ≧80% by weight, and have K values within the range from 8 to 80, preferably within the range from 10 to 40. The K values are an approximate measure of the molecular weight and the degree of polymerization and are determined by the method of H. Fikentscher, Cellulosechemie 13 (1932), 60, in 2% strength by weight solutions in dimethylformamide at 25° C.

Suitable monoethylenically unsaturated monocarboxylic acids are those which contain from 3 to 10 carbon atoms in the molecule. Specific examples are in particular acrylic acid and methacrylic acid; however, it is also possible to use α-hydroxyacrylic acid, vinylacetic acid, allylacetic acid, propylideneacetic acid, ethylidenepropionic acid, dimethylacrylic acid or $C_2$–$C_6$-alkyl monoesters of dicarboxylic acids, especially of maleic acid. Examples of suitable monoethylenically unsaturated dicarboxylic acids for inclusion in the polymers are maleic acid, itaconic acid, glutaconic acid, methylenemalonic acid and citraconic acids or their anhydrides, eg. maleic anhydride. It is also possible to use mixtures of unsaturated mono- or dicarboxylic acids or anhydrides thereof.

In addition to the carboxyl-containing monomers, the polymers may also contain ≦60% by weight, preferably ≦40% by weight, in particular ≦20% by weight, of carboxyl-free, in particular monoethylenically unsaturated monomers which are copolymerizable with the carboxyl-containing monomers. Specific examples are acrylamide, methacrylamide, (meth)acrylonitrile, acrylamidosulfonic acid, vinylsulfonic acid, allylsulfonic acid, vinylphosphonic acid, allylphosphonic acid, vinyl acetate, vinylpropionate, allyl alcohol, acrolein, hydroxyethyl or hydroxypropyl (meth)acrylate, methyl or ethyl (meth)acrylate, styrene, $C_2$–$C_4$-olefins, alkyl vinyl ethers having alkyl radicals with from 1 to 4 carbon atoms, and also mixtures thereof. Of the monomers mentioned, particularly suitable are acrylamide, methacrylamide, vinyl acetate, acrylonitrile, hydroxyethyl acrylate and hydroxypropyl acrylate, methyl vinyl ether and diisobutylene. These comonomers can have a decisive influence on the solubility of dispersants (ii) in water or in dilute alkalis.

In a preferred embodiment, dispersants (ii) comprise water-soluble copolymers of from 40 to 100% by weight, preferably from 60 to 100% by weight, of acrylic acid, methacrylic acid, α-hydroxyacrylic acid or maleic acid or a mixture thereof, and from 0 to 60% by weight, preferably from 0 to 40% by weight, of copolymerizable monomers which are preferably carboxyl-free, having a K value of from 8 to 80.

Particularly good results are obtained in particular with homopolymers of acrylic acid, methacrylic acid and of maleic acid or anhydride, and also copolymers of acrylic acid and methacrylic acid, for example in a weight ratio of 50:50 to 95:5, and copolymers of acrylic acid and maleic acid, for example in a weight ratio of from 20:80 to 80:20.

Particularly favorable dispersants (ii) also include the water-soluble polymers of carboxyl-containing monomers where the carboxyl groups in the polymer are present in the form of sodium salts. However, it is also possible to use the lithium, potassium, ammonium and substituted ammonium salts, for example methyl-, ethyl-, dimethyl-, diethyl-, trimethyl-, triethyl-, diethanol-, triethanol- or triisopropanol-ammonium salts.

The process of the present invention is applied to textiles made of cellulose or blends thereof with other native or synthetic fibers, for example linen, polyester or polyamide. The most important fibers are pure cotton and blends of cotton and polyester.

The object of the present invention, a more efficient, more economical and ecologically improved pretreatment process, is thus achieved by inclusion in the precleaning liquor of dispersants and/or complexing agents for polyvalent metal ions, each alone or mixed, in amounts of from 1% by weight to 10% by weight, preferably from 2 to 6% by weight, based on the textile weight, and an immediately subsequent alkaline peroxide bleach.

The Examples which follow illustrate the invention.

Application testing

The quality of the pretreatment was assessed by subjecting the bleached textile material to the following tests:

The whiteness was measured on a Spectroflash 500 from ICS-Texunion and expressed according to Berger.

The residual peroxide content on the textile material at the start of the bleach (actually, before the start of the bleach) and at the end of the bleaching time was determined titrimetrically with 0.1N $KMnO_4$ solution in a conventional manner. For this, the fabric pieces of a certain (identical) weight were placed in aqueous sulfuric acid solution to stop the peroxide decomposition, and the peroxide present on the material was determined titrimetrically. The amount of peroxide present at the start of the bleach was set equal to 100%, and the residual peroxide level at the end of the bleach was set in relation to it, ie. reported as a percentage of the initial value. The higher the residual peroxide level, the better the stability of the peroxide in the bleach.

The average degree of polymerization (DP) is a measure of fiber damage; the higher the values, or the closer the values to the DP value of the raw material, the lesser the damage. It was determined viscometrically in copper cuoxam solution.

The hydrophilicity of the textile material was determined by measuring the absorption time. A standardized fabric strip (3 cm wide) is dipped 1 cm deep into colored water and the time is measured in seconds for the water to rise by exactly 1 cm in the fabric strip. The absorption time (rise time) is then reported in s/cm. The lower the absorption time, the better the hydrophilicity.

The detection of starch by the Tegewa method, where a spot test with iodine/potassium iodide is used to indicate the starch still present on the fabric by a bluish violet color, is generally known. The degree of desizing can be determined by means of the violet scale of the Tegewa Association, which indicates 9 gradations in color. A rating of 9 denotes complete desizing, while a rating of 1 denotes no desizing whatsoever.

Husk removal was assessed visually.

EXAMPLES 1a–d

A 310 g/m$^2$ cotton twill loomstate fabric sized with water-soluble starch derivatives was impregnated with a liquor at 70° C. to a wet pickup of about 100% (corresponding to a liquor ratio of about 1:1) in the course of a dip time (=contact time between the fabric and the liquor) of 20 seconds, the liquor containing 5 g/l of decaethoxylated nonylphenyl x g/l of additives as per Table 1 and having been adjusted to a pH of 8.5, then immediately washed off twice hot (≧95° C.) and twice cold and then subjected to a peroxide bleach in a steamer at 100° C. for 15 minutes. The bleaching liquor applied with a wet pickup of 125% (corresponding to a liquor ratio of 1.25:1) had the following composition:

40 g/l of hydrogen peroxide (35% strength by weight)

15 g/l of caustic 1 g/l of decaethoxylated nonylphenol 5 g/l of commercial bleach stabilizer (Mg-containing stabilizer based on phosphonic acid and polyacrylic acid).

Following washoff and drying the result obtained was a bleached cotton fabric having the data listed in Table 1. The values clearly reveal the improvement due to the process of the present invention.

TABLE 1

Results of Examples 1a–d

| | Berger whiteness | Residual peroxide [%] | DP | Absorption time [s/cm] | Tegewa value | Husk removal |
|---|---|---|---|---|---|---|
| Loomstate (for comparison) | 17 | — | 2,100 | >120 | 1 | — |
| Precleaned and bleached without additives of invention (for comparison) | 75.3 | 7 | 1,580 | 4.2 | 8 | incomplete |
| Precleaned and bleached according to the invention: additives (type + amount) | | | | | | |
| Ex. 1a 3 g/l of A | 85.2 | 22 | 1,810 | 2.1 | 8 | complete |
| Ex. 1b 4 g/l of B | 86.1 | 23 | 1,790 | 1.9 | 8 | complete |
| Ex. 1c 3 g/l of C | 83.6 | 20 | 1,770 | 2.3 | 8 | complete |
| Ex. 1d 5 g/l of D | 83.0 | 17 | 1,850 | 2.0 | 8 | complete |

A = nitrilotriacetic acid (NTA) + polyacrylic acid of K 15, both as sodium salts, in a weight ratio of 1:1

B = diethylenetriaminepentamethylenephosphonic acid (DTPMP) + copolymer of 45% by weight of acrylic acid/55% by weight of maleic acid of K 25, both as sodium salts, in a weight ratio of 2:1

C = DTPMP, as sodium salt

D = copolymer of 30% by weight of acrylic acid/70% by weight of maleic acid, as sodium salt, of K 12

Repeating Example 1a with product mixture A of the present invention present in the precleaning liquor but a subsequent peroxide bleach with only 5 g/l of caustic soda instead of 15 g/l of caustic soda, afforded incomplete husk removal and a Berger whiteness of only 80.

Comparative Example 1e with Three-stage Procedure

The twill fabric of Example 1a–d was impregnated with a desizing liquor at 60° C. to a wet pickup of about 100% (corresponding to a liquor ratio of about 1:1), the liquor containing 4 g/l of bacterial α-amylase 5 g/l of decaethoxylated nonylphenol 3 g/l of sodium chloride made up with water of about 10° German hardness and adjusted to a pH of about 7, left to stand at room temperature for 24 hours, washed off hot and cold, then subjected to an alkaline scour with 40 g/l of caustic soda 3 g/l of decaethoxylated nonylphenol in a steamer at 100° C. for 15 minutes and also to a peroxide bleach with the following formulation:

40 g/l of hydrogen peroxide (35% strength by weight)

6 g/l of caustic soda 1 g/l of decaethoxylated nonylphenol 5 g/l of bleach stabilizer (as in the case of Ex. 1a–d in the same way as in Example 1a–d but with a wet pickup of 100%. The following test data were obtained: Berger whiteness=82.2, residual peroxide=16%, DP=1680, absorption time=2.0 s/cm, Tegewa value=8, husk removal complete.

The result shows that the two-stage procedure of the present invention can give better pretreatment results than the three-stage procedure.

EXAMPLES 2a–d

A 230 g/cm$^2$ loomstate cotton fabric sized with a mixture of water-soluble starch derivatives and carboxymethylcellulose was impregnated with a precleaning liquor at room temperature to a wet pickup of about 100% in the course of a dip of about 15 seconds, the liquor containing 5 g/l of decaethoxylated nonylphenol x g/l of additives as per Table 1 and having been adjusted to a pH of about 8, immediately washed off (without dwell time) twice hot and twice cold, and then subjected to a peroxide bleach as in Example 1 but with a wet pickup of 100%.

The bleach results for the respective additives used are revealed in Table 2.

Following the impregnation with precleaning liquor by a 20 minute dwell for the impregnated fabric at room temperature results in virtually the same bleach results after the peroxide bleach.

TABLE 2

Results of Examples 2a–d

| | Berger whiteness | Residual peroxide [%] | DP | Absorption time [s/cm] | Tegewa value | Husk removal |
|---|---|---|---|---|---|---|
| Loomstate (for comparison) | 20 | — | 2,250 | >120 | 7 | — |
| Precleaned and bleached without additives of invention (for comparison) | 78.6 | 3 | 1,580 | 4.2 | 8 | incomplete |
| Precleaned and bleached according to the invention: additives (type + amount) | | | | | | |
| Ex. 2a 3 g/l of A | 84.2 | 20 | 1,910 | 2.4 | 7 | complete |
| Ex. 2b 4 g/l of B | 85.1 | 19 | 1,990 | 2.1 | 7 | complete |
| Ex. 2c 3 g/l of C | 82.6 | 14 | 1,870 | 2.6 | 7 | complete |
| Ex. 2d 5 g/l of D | 82.0 | 11 | 1,850 | 2.3 | 7 | complete |

See Table 1 for meaning of A to D

EXAMPLES 3a–d AND 4a–d

A 150 g/m$^2$ loomstate cotton cheesecloth sized with starch derivatives was impregnated with a precleaning liquor of 60° C. to a wet pickup of 100% in the course of a dip time of about 20 seconds, the liquor containing 5 g/l of decaethoxylated nonylphenol x g/l of additives as per Table 3 and having been adjusted to a pH of about 7.5, and then immediately washed off and bleached as described in Example 1.

The treatment results of Examples 3a–d for the respective additives used are listed in Table 3. The improvement due to the procedures of the present invention is clear to see. However, the desizing is not optimal, as indicated by the Tegewa values. To improve the desizing performance the following pretreatment protocol was adopted:

The same cotton cheesecloth as in Examples 3a–d was impregnated with a desizing liquor at 70° C. to a wet pickup of about 100%, the liquor containing 4 g/l of bacterial α-amylase 5 g/l of decaethoxylated nonylphenol 3 g/l of sodium chloride x g/l of additives as in Table 3 made up with water of about 100 German hardness and having been adjusted to a pH of about 7, left to stand at room temperature for 24 hours, then washed off twice hot (>95° C.) and twice cold, the Table 3 additives of the present invention being included in the first hot washbath. This was followed by the peroxide bleach as described in Examples 1a–d. As comparison, the desize and bleach was carried out without including the additives of the present invention in the first washbath.

The pretreatment results of Examples 4a–d are shown in Table 4. The results are similar to Table 3, but distinctly better desizing effects were obtained.

TABLE 3

Results of Examples 3a–d

| | Berger whiteness | Residual peroxide [%] | DP | Absorption time [s/cm] | Tegewa value | Husk removal |
|---|---|---|---|---|---|---|
| Loomstate (for comparison) | 6 | — | 2,450 | >120 | 1 | — |
| Precleaned and bleached without additives of invention (for comparison) | 74.4 | 8 | 1,880 | 3.7 | 6 | incomplete |
| Precleaned and bleached according to the invention: additives (type + amount) | | | | | | |
| Ex. 3a 3 g/l of A | 83.2 | 20 | 2,130 | 2.0 | 6 | complete |
| Ex. 3b 3 g/l of E | 82.4 | 21 | 2.090 | 2.3 | 6 | complete |
| Ex. 3c 5 g/l of F | 81.6 | 18 | 2,170 | 2.1 | 6 | complete |
| Ex. 3d 3 g/l of G | 79.9 | 16 | 1,950 | 2.6 | 6 | complete |

A = nitrilotriacetic acid (NTA) + polyacrylic acid of K 15, both as sodium salts, in a weight ratio of 1:1
E = NTA + copolymer of 80% by weight of acrylic acid/20% by weight of acrylamide (K value = 28), both as sodium salts, in a weight ratio of 2:1
F = DTPMP + poly-α-hydroxyacrylic acid (K 18), both as sodium salts, in a weight ratio of 1:2
G = NTA as sodium salt

TABLE 4

Results of Examples 4a–d

| | Berger whiteness | Residual peroxide [%] | DP | Absorption time [s/cm] | Tegewa value | Husk removal |
|---|---|---|---|---|---|---|
| Loomstate (for comparison) | 6 | — | 2,450 | >120 | 1 | — |
| Desized and bleached without additives of invention in first washbath (for comparison) | 75.9 | 6 | 1,900 | 3.2 | 8 | incomplete |
| Desized and bleached with additives of invention in first washbath: additives (type + amount) | | | | | | |
| Ex. 4a 3 g/l of A | 82.9 | 22 | 2,030 | 1.9 | 8 | complete |
| Ex. 4b 3 g/l of B | 83.4 | 19 | 2,190 | 2.1 | 8 | complete |
| Ex. 4c 5 g/l of C | 82.1 | 16 | 2,070 | 2.0 | 8 | complete |
| Ex. 4d 3 g/l of D | 80.2 | 17 | 1,990 | 2.4 | 8 | complete |

See Table 3 for meaning of A and E to G

In a further version of the process, the additives of the present invention were included not in the first washbath but directly in the desizing liquor. The results substantially correspond to those listed in Table 4.

We claim:

1. A process for the continuous pretreatment of cellulosic textile material comprising:

(a) a precleaning step comprising pretreating in a treatment bath which comprises customary surfactants and other customary auxiliaries, with the exception of reducing agents and buffer systems, and containing customary enzymes and desizing agents and has a pH of from 5 to 11, and wherein the treatment bath is free of bleaching or oxidizing agents and, after washoff and rinse, (b) a bleaching step comprising bleaching with hydrogen peroxide in an alkaline-aqueous liquor which comprises customary surfactants and other customary auxiliaries, wherein the treatment bath of (a) additionally comprises from 1 to 10% by weight, based on the weight of the textile material, (i) either of an aminopolycarboxylic acid, of a hydroxyalkyl- or amino-phosphonic acid, of a polycarboxylic acid, of a polyhydroxycarboxylic acid or a mixture thereof, as complexing agent for polyvalent metal ions, or (ii) of a water-soluble polymer derived from 40 to 100% by weight of monoethylenically unsaturated mono- or di-carboxylic acids or anhydrides, or a mixture thereof, and has a K value of from 8 to 80, as dispersant, or (iii) a mixture of components (i) and (ii) in a weight ratio of from 10:1 to 1:10.

2. A process as claimed in claim 1 wherein the treatment bath of (a) additionally comprises from 1 to 10% by weight, based on the weight of the textile material, of component (i).

3. A process as claimed in claim 1 wherein the treatment bath of (a) additionally comprises from 1 to 10% by weight, based on the weight of the textile material, of component (ii).

4. A process as claimed in claim 1 wherein the treatment bath of (a) additionally comprises from 1 to 10% by weight, based on the weight of the textile material, of a mixture (iii) of components (i) and (ii) in a weight ratio of 10:1 to 1:10.

5. A process as claimed in claim 1 wherein the treatment bath of (a) comprises the additional components (i) or (ii) or the mixture (iii) of (i) and (ii) in an amount of from 2 to 6% by weight, based on the weight of the textile material.

6. A process as claimed in claim 1 wherein the complexing agent (i) is nitrilotriacetic acid, diethylenetriaminepentamethylenephosphonic acid or poly-α-hydroxyacrylic acid.

7. A process as claimed in claim 1 wherein dispersant (ii) is a water-soluble polymer derived from 40 to 100% by weight of acrylic acid, methacrylic acid, α-hydroxyacrylic acid or maleic acid, or a mixture thereof, and has a K value of from 8 to 80.

8. A process claimed in claim 1 wherein the precleaning step (a) is carried out at from 20° to 100° C.

9. A process as claimed in claim 1 wherein the bleaching step (b) is carried out at from 70° to 130° C.

10. A process as claimed in claim 1 wherein the bleaching step is carried out at a ratio of the weight of the liquor employed to the weight of the textile material of from 0.6:1 to 1.7:1.

* * * * *